US009982971B2

(12) United States Patent
Park

(10) Patent No.: US 9,982,971 B2
(45) Date of Patent: May 29, 2018

(54) SHOOTING TRAINING CONTROL SYSTEM HAVING PENABLE/CLOSABLE BOOTH TYPE SHOOTING LINE

(71) Applicant: Byong Chul Park, Changwon-si (KR)

(72) Inventor: Byong Chul Park, Changwon-si (KR)

( * ) Notice: Subject to any disclaimer, the term of this patent is extended or adjusted under 35 U.S.C. 154(b) by 41 days.

(21) Appl. No.: 15/159,802

(22) Filed: May 20, 2016

(65) Prior Publication Data

US 2016/0341527 A1 Nov. 24, 2016

(30) Foreign Application Priority Data

May 22, 2015 (KR) ..... 10-2015-0072138

(51) Int. Cl.
*F41A 33/00* (2006.01)
*F41J 11/02* (2009.01)

(52) U.S. Cl.
CPC ..... *F41J 11/02* (2013.01)

(58) Field of Classification Search
USPC ..... 434/11, 16, 19, 23, 27; 273/404, 406, 273/410
See application file for complete search history.

(56) References Cited

U.S. PATENT DOCUMENTS 4,247,115 A * 1/1981 Nikoden, Jr. ..... F41J 11/00 108/48
4,307,292 A * 12/1981 Knight ..... F41J 5/06 235/400
4,509,301 A * 4/1985 Head ..... E04H 1/125 273/404
4,598,631 A * 7/1986 Everett ..... F24F 7/10 273/348
4,683,688 A * 8/1987 Wojcinski ..... E04B 1/34336 273/404
5,088,741 A * 2/1992 Simonetti ..... E04B 1/34368 273/406
6,162,057 A * 12/2000 Westphal ..... F41J 11/00 434/11
7,967,296 B1 * 6/2011 Halverson ..... F41J 11/00 273/404
2005/0257479 A1 * 11/2005 Nygren ..... E04H 9/10 52/584.1
2006/0107985 A1 * 5/2006 Sovine ..... E04H 9/10 135/96
2015/0184985 A1 * 7/2015 Stear ..... F41J 11/00 273/406

* cited by examiner

*Primary Examiner* — Kurt Fernstrom
(74) *Attorney, Agent, or Firm* — Hauptman Ham, LLP

(57) ABSTRACT

The present invention relates to a shooting training control system having a plurality of shooting lines arranged in parallel to each other to allow a plurality of shooters to be located thereon to conduct shooting and a shooting control room for controlling shooting training of the plurality of shooters, the shooting training control system including: isolation covers disposed on the respective shooting lines, forming isolation spaces from the ground to allow the shooters to be located therein, and having both sides isolated from the adjacent shooting lines thereto; opening and closing means for opening and closing each isolation cover from the ground; and switching means disposed in the shooting control room to control the opening and closing means, so that each isolation cover is open and closed to open and close the isolation space formed therein.

11 Claims, 5 Drawing Sheets

SHOOTING TRAINING CONTROL SYSTEM HAVING PENABLE/CLOSABLE BOOTH TYPE SHOOTING LINE

BACKGROUND OF THE INVENTION

Field of the Invention

The present invention relates to a shooting training control system for preventing emergency situations from happening in a shooting training range, and more particularly, to a shooting training control system having openable/closable booth type shooting lines that completely isolates shooters located on the shooting lines from each other through isolation covers, thereby preventing accidents caused by bullet discharge.

Background of the Related Art

A shooting range is provided for the purpose of military shooting training or sports. In such shooting range, shooters are located on a plurality of shooting lines arranged in parallel to each other, and in this state, bullets are discharged to targets disposed in front of the shooters. In the shooting range, accordingly, both of safety accidents and intentional accidents due to the bullet discharge may raise problems.

According to a system prepared in the shooting range, at present, the shooters located in parallel to each other are just controlled individually by means of management manpower. Under such system, however, there is basically a danger which the shooters may become targets of their firearms. For example, no complete safety measures for the shooters located in parallel to each other have been proposed even in Korean Patent Nos. 10-1215324 B1 and 10-1386051 B1.

SUMMARY OF THE INVENTION

Accordingly, the present invention has been made in view of the above-mentioned problems occurring in the prior art, and it is an object of the present invention to provide a shooting training control system that is capable of selectively isolating shooters who conduct shooting on shooting lines from each other, thereby preventing accidents caused by firearms.

It is another object of the present invention to provide a shooting training control system that is capable of selectively dividing or isolating one shooting line for shooting from adjacent shooting lines thereto, thereby preventing safety accidents and unexpected firearm accidents from happening.

To accomplish the above-mentioned objects, according to the present invention, there is provided a shooting training control system having a plurality of shooting lines arranged in parallel to each other to allow a plurality of shooters to be located thereon to conduct shooting and a shooting control room for controlling shooting training of the plurality of shooters, the shooting training control system including: isolation covers disposed on the respective shooting lines, forming isolation spaces from the ground to allow the shooters to be located therein, and having both sides isolated from the adjacent shooting lines thereto; opening and closing means for opening and closing each isolation cover from the ground; and switching means disposed in the shooting control room to control the opening and closing means, so that each isolation cover is open and closed to open and close the isolation space formed therein.

According to the present invention, preferably, each isolation cover is formed of a pair of isolation covers symmetrically located to open and close the isolation space through the rotation around hinge shafts disposed on the outer side end portions contacted with the ground in the longitudinal directions thereof, so that in the state where the isolation cover is closed, the inner side end portions of the pair of isolation covers contacted with each other in the longitudinal directions thereof are isolated from the ground to form the isolation space in the isolation cover. In this case, the opening and closing means includes opening and closing cylinder modules adapted to rotate the pair of isolation covers around the hinge shafts.

According to the present invention, preferably, each isolation cover is formed of a single isolation cover having a section forming the isolation space between both side end portions thereof contacted with the ground in the longitudinal direction thereof and rotating around a hinge shaft disposed on any one side end portion thereof in the longitudinal direction thereof to open and close the isolation space formed therein. In this case, the opening and closing means includes opening and closing cylinder modules adapted to rotate the single isolation cover around the hinge shaft.

According to the present invention, preferably, each isolation cover is formed of a pair of isolation covers symmetrically located to open and close the isolation space through the rotation around support shafts disposed on the outer side end portions contacted with the ground in the longitudinal directions thereof, so that in the state where the isolation cover is closed, the inner side end portions of the pair of isolation covers contacted with each other in the longitudinal directions thereof are isolated from the ground to form the isolation space in the isolation cover, and the opening and closing means includes means for forwardly and reversely rotating the support shafts.

According to the present invention, preferably, each isolation cover is formed of a single isolation cover having a section forming the isolation space between both side end portions thereof contacted with the ground in the longitudinal direction thereof and rotating around a support shaft disposed on any one side end portion thereof in the longitudinal direction thereof to open and close the isolation space formed therein, and the opening and closing means includes means for forwardly and reversely rotating the support shaft.

According to the present invention, preferably, each isolation cover has a sound absorbing sheet attached to the internal surface thereof to absorb the noise generated upon shooting.

According to the present invention, preferably, the shooting training control system further includes an emergency button located on the inner side of each isolation cover to transmit an emergent situation of the shooter to the outside and an emergency lamp located on the external surface of each isolation cover to inform the outside of the emergent situation of the shooter if the emergency button operates.

According to the present invention, preferably, the shooting training control system further includes a camera located on each isolation cover to obtain video data in the isolation space and a video data server located in the shooting control room to store the video data obtained from the camera therein.

According to the present invention, preferably, each isolation cover has a magazine supply hole formed on one side thereof to supply a magazine for shooting to the shooter from the outside.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, an explanation on a shooting training control system having openable/closable booth type shooting lines according to the present invention will be in detail given with reference to the attached drawing.

Figure 1A:
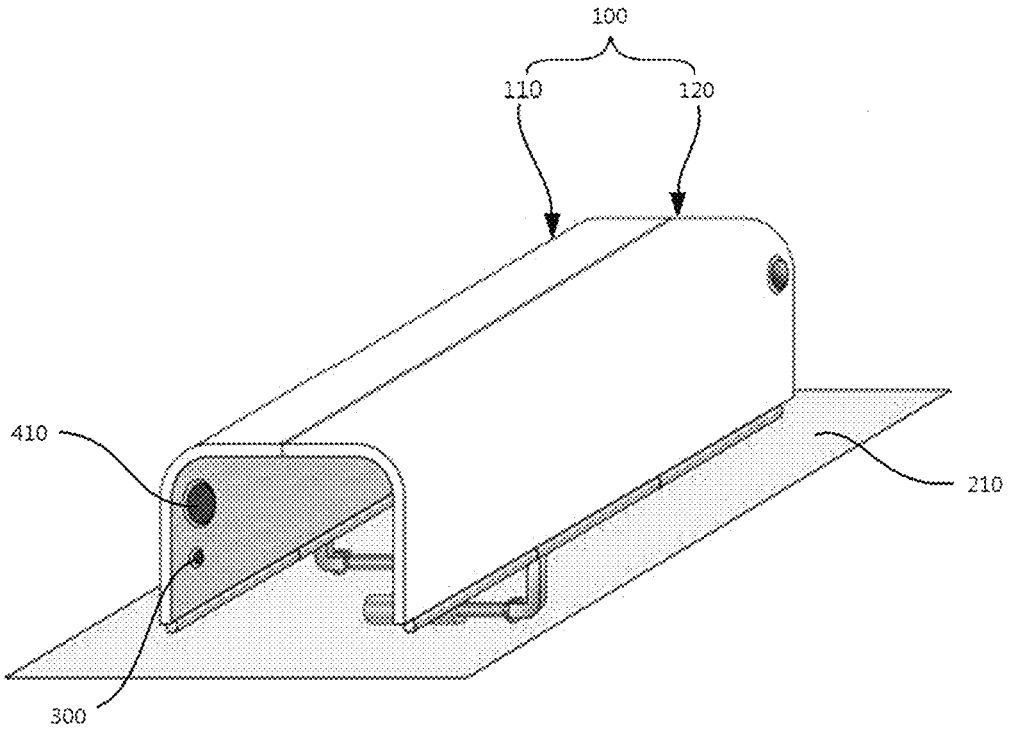
FIGS. 1*a* and 1*b* are perspective views showing the configuration and operation of a shooting training control system having openable/closable booth type shooting lines according to a first embodiment of the present invention.
Figure 1B:
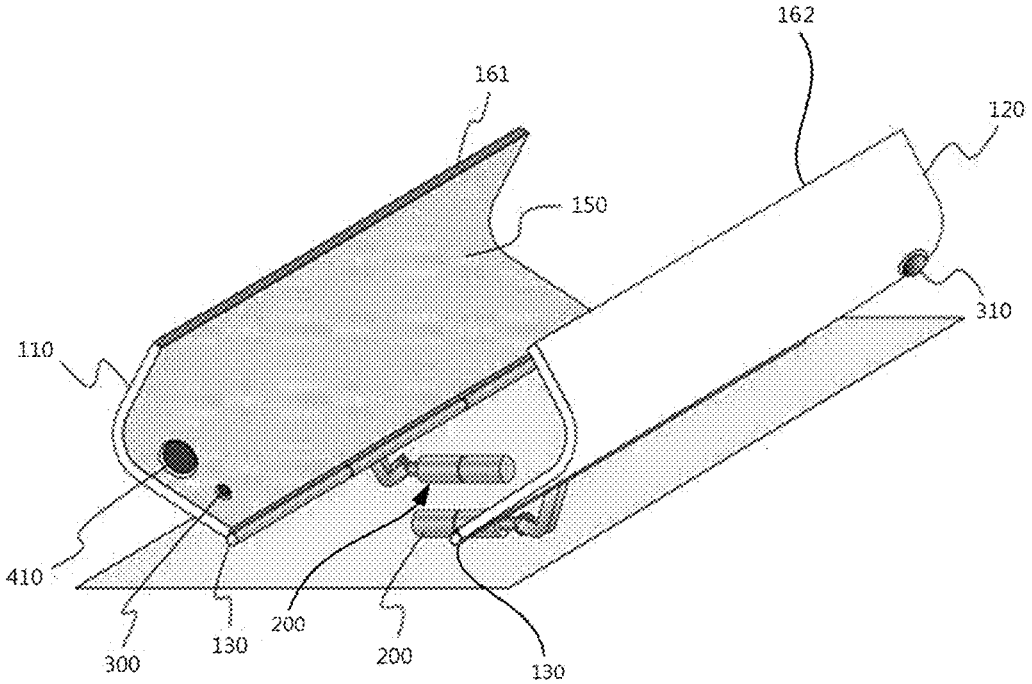

As shown in FIGS. 1*a* and 1*b*, an isolation cover 100 is disposed on one shooting line 210 in a shooting training control system according to a first embodiment of the present invention. As shown, the isolation cover 100, which isolates a shooter located on the shooting line 210 from shooters positioned on the adjacent shooting lines 210 thereto, includes a pair of isolation covers 110 and 120. FIG. 1*a* shows the closed state of the isolation cover 100, and FIG. 1*b* shows the open state of the isolation cover 100.

As shown, for example, the pair of isolation covers 110 and 120 has an L-shaped sectional shape and an isolation space formed in the interior thereof to accommodate the shooter thereinto. The portions of the pair of isolation covers 110 and 120 contacted with the ground, that is, the outer side end portions of the pair of isolation covers 110 and 120 in the longitudinal directions thereof are rotatably supported against hinge shafts 130. Further, the isolation covers 110 and 120 are open and closed by means of the operations of opening and closing cylinder modules 200. The opening and closing cylinder modules 200 are formed of hydraulic cylinders or air cylinders, so that, through the linear reciprocating motions of piston rods generated when a fluid goes out and comes in, the isolation covers 110 and 120 are open and closed.

Only if the opening and closing cylinder modules 200 open and close the isolation cover 100, they may be freely varied in shape and configuration. As shown, the pair of isolation covers 110 and 120, which is open and closed by means of the opening and closing cylinder modules 200, is desirably molded to the state wherein the front side thereof at which a target is located is open. Further, the pair of isolation covers 110 and 120 is desirably open on the rear side thereof in consideration of the malfunctions of a driving device thereof.

According to the first embodiment of the present invention, the isolation cover 100 is open and closed by means of the opening and closing cylinder modules 200, but of course, devices for opening and closing the isolation cover 100 are not limited to the cylinder modules 200 formed of the hydraulic cylinders or air cylinders. For example, the portions of the pair of isolation covers 110 and 120 contacted with the ground, that is, the outer side end portions thereof in the longitudinal directions thereof are connected with support shafts in such a manner as to cooperatively operate with each other. That is, the hinge shafts 130 are changed into the support shafts cooperatively operating with the pair of isolation covers 110 and 120. At this time, of course, the support shafts are rotatably supported on positions adjacent to the ground. Under the configuration, if the support shafts connected to the pair of isolation covers 110 and 120 rotate in a forward or reverse direction, the pair of isolation covers 110 and 120 is open or closed.

In this case, only if any members rotate the support shafts connected to the outer side end portions of the isolation covers 110 and 120 in the longitudinal directions thereof are rotated, they rotate the isolation covers 110 and 120 to allow the isolation space formed in the interiors of the isolation covers 110 and 120 to be open to the outside or closed from the outside. For example, one or more gears are mounted on the support shafts, and rotary forces of driving motors are transmitted to the support shafts through the gears, so that the support shafts rotate forwardly and reversely to allow the isolation covers 110 and 120 to be open and closed.

An emergency button 300 is located on the inner surface of any one side of the isolation covers 110 and 120, to allow the shooter located in the isolation space of the isolation covers 110 and 120 to request help to the outside. If the shooter is in an abnormal situation wherein, for example, his or her firearm has a problem, the emergency button 300 is pressed to notify the outside of the abnormal situation.

If the emergency button 300 operates, an emergency lamp 310 is disposed on any external surface of the isolation covers 110 and 120 to allow the operation of the emergency button 300 to be recognized to the outside. Desirably, the emergency button 300 is disposed on the front side of any internal surface of the isolation covers 110 and 120, thereby allowing a shooter's hand to easily reach the emergency button 300, and the emergency lamp 310 is disposed on the rear side of any external surface of the isolation covers 110 and 120, thereby being easily recognized from the outside and being safe in position.

Figure 2:
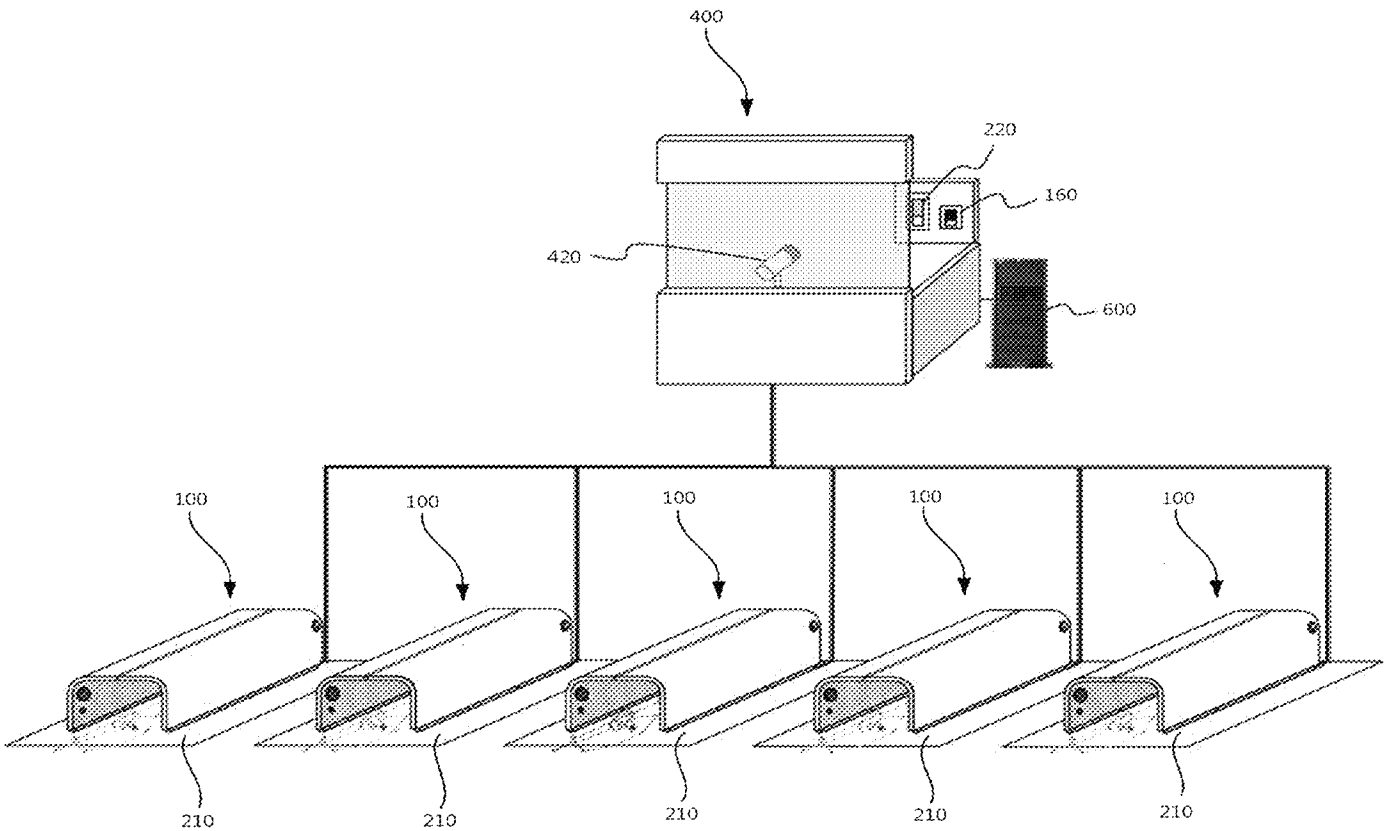
FIG. 2 is an exemplary view showing the whole configuration of the shooting training control system having openable/closable booth type shooting lines according to the first embodiment of the present invention.

Further, a speaker 410 is disposed on any internal surface of the isolation covers 110 and 120. The speaker 410 is adapted to allow the sounds generated from a shooting control room 400 as shown in FIG. 2 to be transmitted well to the interior of the isolation cover 100. For example, the voice of a controller for conducting shooting training or practice is inputted from a microphone 420 disposed in the shooting control room 400 and outputted to the speaker 410, thereby allowing the shooters to be more easily controlled.

The shooting control room 400 has an opening and closing button 220 for opening and closing the plurality of isolation covers 100. In the state where the shooters enter the isolation covers 100, for example, the isolation covers 110 and 120 are open and closed by means of the manipulation of the opening and closing button 220 by the controller of the shooting control room 400. Under the above-mentioned configuration, next, an explanation on the operation of the shooting training control system according to the present invention will be briefly given.

Through the manipulation of the opening and closing button 220 as switching means in the shooting control room 400, first, the isolation covers 110 and 120 rotate around the hinge shafts 130 by means of the opening and closing cylinder modules 200, and then, they are open. Through the signals of the opening and closing button 220, that is, the opening and closing cylinder modules 200 operate to allow the isolation covers 110 and 120 to be open. In the state where the isolation covers 110 and 120 are open, the shooters enter the isolation covers 110 and 120 and take his or her shooting postures. After that, the opening and closing cylinder modules 200 connected to the isolation covers 110 and 120 operate to allow the isolation covers 110 and 120 to be closed through the manipulation of the opening and closing button 220.

If the isolation covers 110 and 120 are closed, the shooters located on the interiors thereof cannot open the isolation covers 110 and 120 arbitrarily. In the state where the isolation covers 110 and 120 are closed, like this, gunfire accidents caused by adjacent shooters do not happen at all. According to the present invention, further, it is desirably necessary to more reliably prevent the isolation covers 110 and 120 from being open by means of the manipulation or force in the interiors of the isolation covers 110 and 120 in the state where the isolation covers 110 and 120 are closed.

For example, an electromagnetic pad 161, which has magnetism when electric current is applied thereto, is disposed on one side end portion of the pair of end portions of the isolation covers 110 and 120 contacted with each other, that is, on the inner side end portions in the longitudinal directions thereof, and a steel plate 162, which serves as a magnetic material having an attractive force in response to the magnetic force generated from the electromagnetic pad 161, is disposed on the other side end portion thereof. Further, a locking switch 160 is disposed in the shooting control room 400 so as to turn on/off power. Accordingly, the electromagnetic pad 161 and the steel plate 162 serve as auxiliary locking devices for preventing the isolation covers 110 and 120 from being arbitrarily open.

In the state where the isolation covers 110 and 120 are closed by means of the opening and closing cylinder modules 200, of course, the auxiliary locking devices for preventing the isolation covers 110 and 120 from being arbitrarily open by means of external forces are not limited to the electromagnetic pad 161 and the steel plate 162. For example, only if the auxiliary locking devices operate by means of the locking switch 162 of the shooting control room 400 and open and close the isolation covers 110 and 120 in a fastened or unfastened state to/from each other, they may be freely changed in shape or configuration.

Next, an explanation on a shooting training control system having capsule type shooting lines according to a second embodiment of the present invention will be given with reference to FIG. 4. According to the second embodiment of the present invention, a single isolation cover 100 is disposed on a shooting line 220 in a shooting range to isolate a shooter located on the shooting line 220 from shooters in the adjacent shooting lines 220 thereto. Both side end portions of the isolation cover 100 are close to the ground, and the interior of the isolation cover 100 has an isolation space in which the shooter is located. For example, the isolation cover 100 has a semicircular sectional shape having a given length to form the isolation space from the ground.

Further, the isolation cover 100 is rotatably supported against a hinge shaft 132 disposed on the portion of the isolation cover 100 contacted with the ground, that is, one side end portion thereof in the longitudinal direction thereof. Further, the isolation cover 100 is open and closed through the rotation around the hinge shaft 132. According to the second embodiment of the present invention, opening and closing cylinder modules 200 are located on the isolation cover 100, and through the operations of the opening and closing cylinder modules 200, the isolation cover 100 rotates around the hinge shaft 132 in such a manner as to be open and closed.

As mentioned above, however, the device for opening and closing the isolation cover 100 may be freely changed. For example, a support shaft is disposed along the end portion of the cover 100 in the longitudinal direction thereof in such a manner as to cooperatively operate with the isolation cover 100, and through the rotation of the support shaft, the isolation cover 100 is open and closed. In more detail, the support shaft rotates by means of a reversible motor and gear trains.

In the same manner as in the first embodiment of the present invention, an emergency button 300 is located on the inner side of the isolation cover 100 so as to allow the shooter located in the isolation space of the isolation cover 100 to request help to the outside. If the emergency button 300 operates, the operation of the emergency button 300 is recognized from the outside by means of an emergency lamp 310 located on the external surface of the isolation cover 100.

Further, a speaker 410 is located on the internal surface of the isolation cover 100. The speaker 410 is adapted to allow the sounds generated from a shooting control room 400 as shown in FIG. 2 to be transmitted well to the interior of the isolation cover 100. For example, the voice of the controller for conducting shooting training or practice is inputted from the microphone 420 disposed in the shooting control room 400 and outputted to the speaker 410, thereby allowing the shooters to be more easily controlled.

The shooting control room 400 has an opening and closing button 220 for opening and closing the isolation cover 100. In the state where the shooters enter the isolation cover 100, for example, the opening and closing cylinder modules 200 are driven to open or close the isolation cover 100 by means of the manipulation of the opening and closing button 220 by the controller of the shooting control room 400. In the same manner as in the first embodiment of the present invention, of course, an electromagnetic pad 161 is disposed on the end portion of the isolation cover 100 opposite to the hinge shaft 130 in the longitudinal direction of the isolation cover 100, and a steel plate 162, which serves as a magnetic material having an attractive force in response to the magnetic force generated from the electromagnetic pad 161, is disposed on the ground corresponding to the end portion of the isolation cover 100. Further, the auxiliary locking devices like the electromagnetic pad 161 and the steel plate 162 are locked or unlocked by means of the manipulation of a locking switch 160 disposed in the shooting control room 400.

Figure 4:
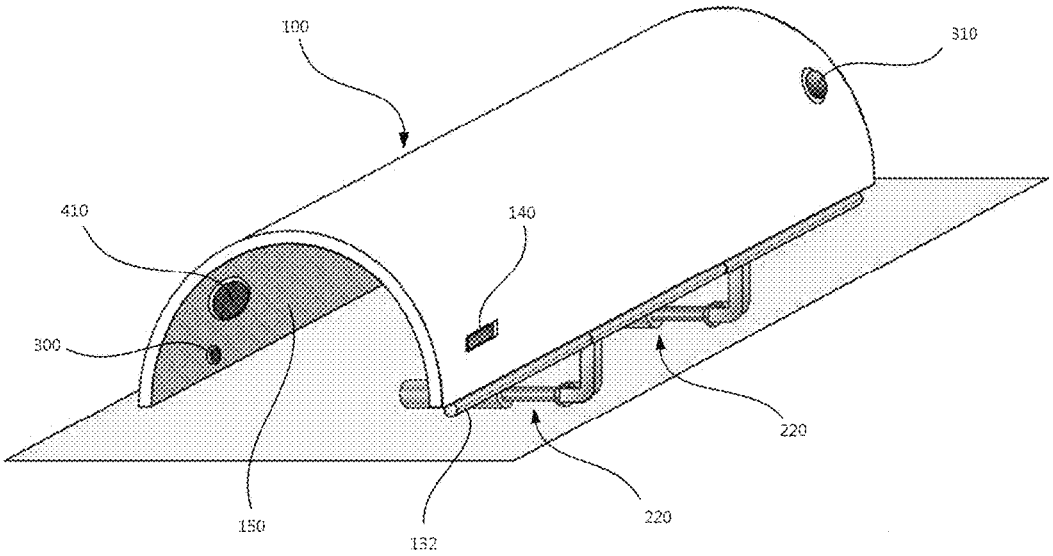
FIG. 4 is a perspective view showing a shooting training control system having capsule type shooting lines according to a second embodiment of the present invention.

As described above, the isolation cover 100, which forms the given space in which the shooter is located on the shooting line having a given area and isolates the shooter located on the shooting line from the shooters located in the adjacent shooting lines thereto through the given space formed therein, is formed of the two isolation covers 110 and 120 as shown in FIGS. 1*a* and 1*b* and the single isolation cover 100 as shown in FIG. 4.

Figure 3:
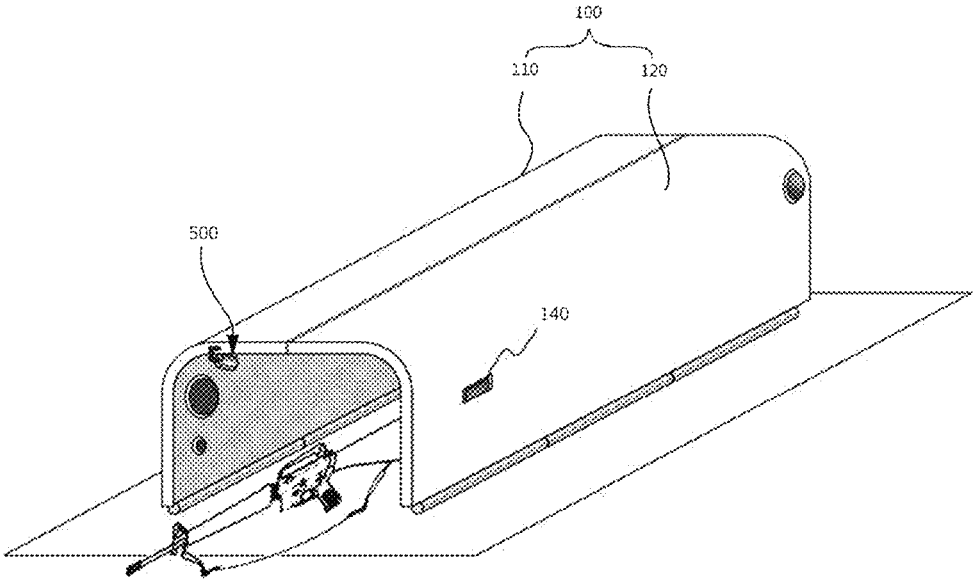
FIG. 3 is a perspective view showing the shooting training control system having openable/closable booth type shooting lines according to the first embodiment of the present invention, wherein each openable/closable booth type shooting line has a camera and a magazine supply hole.

According to the present invention, as shown in FIG. 3, a camera 500 is located on any one side of the isolation covers 110 and 120 so as to photograph the internal space of the isolation cover 100. The video data on the internal situation of the camera 500 is stored, for example, in a recording device 600 disposed in the shooting control room 400. The video and voice information obtained by the camera 500 and the recording device 600 serve as materials informing the outside of the accurate state of the shooter upon shooting or upon accidents.

If the isolation cover 100 is closed, further, the internal width of the isolation cover 100 is smaller than the length of the firearm used for shooting, which prevents accidents from happening. As shown in FIG. 3, a magazine supply hole 140 is formed on one side of the isolation cover 100 to supply the magazine for shooting to the shooter from the outside. If the magazine supply hole 140 is formed, desirably, safety accidents are prevented from happening to the adjacent shooters to the corresponding shooter.

According to the present invention, further, a sound absorbing sheet 150 is attached to the internal surface of the isolation cover 100 to absorb the noise generated upon shooting, thereby desirably reducing strong shot sounds generated upon shooting. It is also possible that a portion of the isolation cover 100 is molded with a transparent material through which the interior of the isolation cover 100 is seen. If so, the internal situation of the isolation cover 100 is in real time checked from the outside, so that the shooting controller can rapidly recognize current and abnormal situations of the shooter and appropriately prepare for them.

As described above, the shooting training control system according to the present invention is configured to completely isolate the shooters located on the shooting lines from each other while the shooters are conducting shooting, thereby preventing the adjacent shooters from being exposed to accidents caused by bullet discharge. According to the present invention, further, the isolation cover is open and closed under the control of the shooting control room, thereby allowing the shooters in the shooting range to be more easily controlled. According to the present invention, furthermore, the variety of parts disposed on the internal and external sides of the isolation cover are usefully available if they are needed by the shooters, and also, needs for controlling persons and control room are satisfied sufficiently.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A shooting training control system having a plurality of shooting lines arranged in parallel to each other to allow a plurality of shooters to be located thereon to conduct shooting and a shooting control room for controlling shooting training of the plurality of shooters, the shooting training control system comprising:

isolation covers disposed on the respective shooting lines, forming isolation spaces from the ground to allow the shooters to be located therein, and having both sides isolated from the adjacent shooting lines thereto;

opening and closing means for opening and closing each isolation cover from the ground; and switching means disposed in the shooting control room to control the opening and closing means, so that the each isolation cover is open and closed to open and close the isolation space formed therein.

2. The shooting training control system according to claim 1, wherein the each isolation cover is formed of a pair of isolation cover portions symmetrically located to open and close the isolation space through rotation around hinge shafts disposed on outer side end portions contacted with the ground in longitudinal directions thereof, so that in the state where the each isolation cover is closed, inner side end portions of the pair of isolation cover portions contacted with each other in the longitudinal directions thereof are isolated from the ground to form the isolation space in the each isolation cover.

3. The shooting training control system according to claim 1, wherein each isolation cover is formed of a single isolation cover portion having a section forming the isolation space between both side end portions thereof contacted with the ground in the longitudinal direction thereof and rotating around a hinge shaft disposed on any one side end portion thereof in the longitudinal direction thereof to open and close the isolation space formed therein.

4. The shooting training control system according to claim 2, wherein the opening and closing means comprises opening and closing cylinder modules adapted to rotate the pair of isolation cover portions around the hinge shafts.

5. The shooting training control system according to claim 3, wherein the opening and closing means comprises opening and closing cylinder modules adapted to rotate the single isolation cover portion around the hinge shaft.

6. The shooting training control system according to claim 1, wherein the each isolation cover is formed of a pair of isolation cover portions symmetrically located to open and close the isolation space through rotation around support shafts disposed on outer side end portions contacted with the ground in longitudinal directions thereof, so that in the state where the each isolation cover is closed, inner side end portions of the pair of isolation cover portions contacted with each other in the longitudinal directions thereof are isolated from the ground to form the isolation space in the each isolation cover, and the opening and closing means comprises means for forwardly and reversely rotating the support shafts.

7. The shooting training control system according to claim 1, wherein the each isolation cover is formed of a single isolation cover portion having a section forming the isolation space between both side end portions thereof contacted with the ground in the longitudinal direction thereof and rotating around a support shaft disposed on any one side end portion thereof in the longitudinal direction thereof to open and close the isolation space formed therein, and the opening and closing means comprises means for forwardly and reversely rotating the support shaft.

8. The shooting training control system according to claim 1, wherein the each isolation cover has a sound absorbing sheet attached to internal surface thereof to absorb the noise generated upon shooting.

9. The shooting training control system according to claim 1, further comprising an emergency button located on inner side of the each isolation cover to transmit an emergent situation of the shooter to outside of the each isolation cover and an emergency lamp located on external surface of the each isolation cover to inform the outside of the emergent situation of the shooter if the emergency button operates.

10. The shooting training control system according to claim 1, further comprising a camera located on the each isolation cover to obtain video data in the isolation space and a video data server located in the shooting control room to store the video data obtained from the camera therein.

11. The shooting training control system according to claim 1, wherein the each isolation cover has a magazine supply hole formed on one side thereof to supply a magazine for shooting to the shooter from outside of the each isolation cover.

* * * * *